United States Patent [19]

Marshall

[11] 4,426,947

[45] Jan. 24, 1984

[54] SEWING MACHINES

[76] Inventor: Eric J. Marshall, 5 Carlton Gardens, London SW1, England

[21] Appl. No.: 276,353

[22] PCT Filed: Oct. 15, 1980

[86] PCT No.: PCT/GB80/00166

§ 371 Date: Jun. 10, 1981

§ 102(e) Date: Jun. 10, 1981

[87] PCT Pub. No.: WO81/01020

PCT Pub. Date: Apr. 16, 1981

[30] Foreign Application Priority Data

Oct. 15, 1979 [GB] United Kingdom ..... 7935670
Oct. 15, 1979 [GB] United Kingdom ..... 7935671
Oct. 15, 1979 [GB] United Kingdom ..... 7935672

[51] Int. Cl.[3] ..... D05B 69/10; D05B 69/22; D05B 47/00

[52] U.S. Cl. ..... 112/272; 112/220; 112/275; 112/255; 112/260; 112/324

[58] Field of Search ..... 112/272, 275, 220, 255, 112/271, 274, 324, 260

[56] References Cited

U.S. PATENT DOCUMENTS 2,416,941 3/1947 Mueller ..... 112/176
3,044,424 7/1962 Kehrer ..... 112/272 X
3,331,346 7/1967 Firestein ..... 112/272
3,359,931 12/1967 Miller et al. ..... 112/272 X
3,599,585 8/1971 Myrick ..... 112/272 X

FOREIGN PATENT DOCUMENTS 1091417 10/1960 Fed. Rep. of Germany .
1343767 10/1963 France .
923263 4/1963 United Kingdom .

OTHER PUBLICATIONS

Manufacturing Clothier, vol. 60, No. 12, issued Dec. 1979 (London, GB) see p. 44, columns 2 and 3

*Primary Examiner*—H. Hampton Hunter
*Attorney, Agent, or Firm*—Cushman, Darby & Cushman

[57] ABSTRACT

In a sewing machine having an upper presser (6), a work feed (8) disposed below and aligned with the upper presser (6), and a work support (9) about the feed mechanism (8), the feed mechanism (8) and the work support (9) are movable in unison to a raised position adjacent the upper presser and into a lowered position in which the feed mechanism is spaced further from the upper presser, the feed mechanism and the work support being resiliently loaded upwardly. In another aspect, a drive for a thread take-up element includes a rotary axially-acting cam (15,23), and a cam follower (24) coupled to the thread take-up element (25,29). In a foot-operable electrical control, primarily for an electrically powered sewing machine, there is a foot-actuatable member (35) carried by a support (33,34) and movable within a range, a locating means (42,43,44) to locate the foot-actuatable member at (and/or to urge it towards) an unconstrained rest position intermediate its range of movement, and respective electrical controls (**45,46,47*a*,47*b*) operable by the foot-actuatable member (35**) as it moves to one side and the other of its rest position.

7 Claims, 5 Drawing Figures

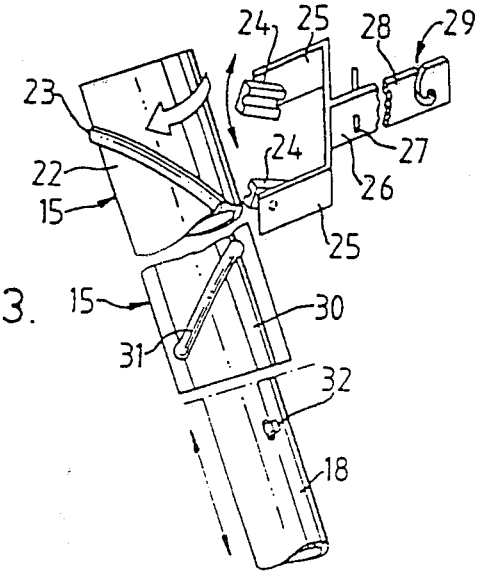
FIG. 3.
FIG. 4.
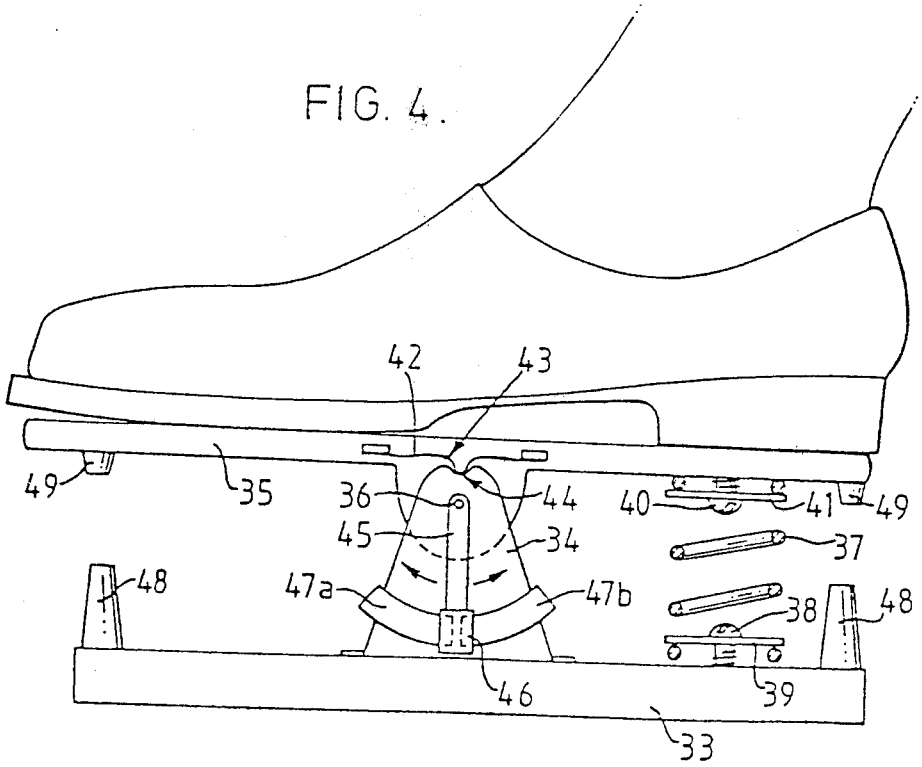

SEWING MACHINES

This invention relates to hand sewing machines, and provides improvements directed respectively to a work support platen, an upper thread feed, and a foot-operable control for an electric drive motor for the machine.

A support surface, for material being stitched, is located generally adjacent to the conventional presser foot, needle, and material feed mechanism. With hand sewing machines it is usual for the material to be passing over such area in the direction away from the operator, usually with general guidance by hand.

In certain conventional hand sewing machines the material is fed to the needle between a spring-loaded presser foot above the material, and a reciprocating serrated feed mechanism below the material and located below the presser foot.

To accommodate the present variety of synthetic and natural materials, the various thicknesses of cloth, a variable pressure can be applied between the presser foot and the feed mechanism. This can ensure an even stitch through all materials by virtue of the operator applying an optimum pressure on the presser foot. It is conventional to adjust the downward pressure of the presser foot by selection of any one of a number of settings of spring loading.

To place the material between the presser foot and the material feed mechanism prior to sewing, it is necessary to raise the presser foot to a certain height. A lever is located at the rear of the usual sewing head in a vertical line with the presser foot. When this lever is raised the presser foot will move farther away from the feed mechanism, and thus will permit material to pass freely between the two. This is normal procedure prior to or immediately after a sewing sequence and with the needle static and in the raised position.

It is desirable that a person operating a sewing machine shall be able to exercise the maximum degree of control over the sewing job in hand. Ideally, this is done with both hands in constant contact with the material and lightly pressed thereon and passing over the static work supporting surface, surrounding the feed mechanism, as sewing proceeds.

However, the sewing procedure often has to be interrupted due to additional hand operations being required, e.g. the lifting of the presser foot. This is usual, for instance, when changing the direction of a sewing run, forming a buttonhole, or attempting to sew through a heavy seam.

A first object of the present invention is accordingly to provide an improvement to overcome the need for the operator to resort to separate and additional hand operations during a sewing task, whereby the operator may have continual and constant contact with the material during sewing.

It is conventional in domestic sewing machines to provide means whereby the thread is released and subsequently "taken-up" from the lower rotary hook during the formation of each individual stitch. The expression "take-up" is intended, in the context of this specification, to refer to the act of a take-up arm in moving to draw back or take up the upper feed of thread during its circumvolution of a lower bobbin case and rotary hook.

Each stitch is formed by a single rotation of the lower rotary hook which draws off thread from a descending needle. Thread for the upper feed is taken to the needle from a reel and through a series of guides, a take-up arm and a tensioner.

In order that the thread shall be formed into a loop to make the stitch on the rotating lower hook, it is necessary for the rotary hook to draw off a suitable length of thread through the needle. This loop is made at the forming of each and every stitch.

However, there must be a facility to "take-up" and tighten each stitch by drawing the thread back through the rising needle at the completion phase of the stitch. This is carried out by the take-up arm through which the thread passes, as the arm moves in a phased sequence relative to the needle and rotating hook.

Certain features of the conventional take-up arm are undesirable inasmuch as the arm, by virtue of its function and operation, is of long length and inhibits case design. Numerous moving parts are required for the complex phase action of the arm, and there are commonly attendant velocity and acceleration problems, both of which contribute to running noise.

For a conventional form of take-up arm, movement is derived from a rotational shaft through a double-cranked movement and with regulating cross-linkage to give a desired amplitude of movement and the velocity changes necessary in the take-up arm to pull the thread back from the lower rotary hook.

A second object of this invention is accordingly to provide an improved means for actuating a take-up arm whereby the size of the sewing head, and also the number of driven and moving parts can be reduced, with minimizing of inertial problems.

A third object of the invention to provide an improved construction of foot-operable electrical control which permits the obtaining of at least two discrete progressive control operations, alternatively one to the other, by manipulation with the same foot.

According to a first aspect of the present invention, a sewing machine has an upper work presser element, a work feed mechanism disposed below and aligned with the upper work presser element, and a work supporting means at least partially surrounding the feed mechanism, said work feed mechanism and said work supporting means being movable to unison into a first position in which said feed mechanism is adjacent to the underside of the upper work presser element, and into a second position in which said feed mechanism is spaced further below the presser element, said feed mechanism and work supporting means being resiliently loaded upwardly towards said presser element.

In a preferred form, said feed mechanism is carried by said work supporting means, and said feed mechanism and work supporting means move as a unit.

The work supporting means may advantageously be a platen forming a portion of a work structure the remainder of which, e.g. generally downstream of the feed mechanism, is static.

The movement of the feed mechanism and work supporting means, relative to the presser element, may be linear and either normal or at an inclination to the normal through the plane of a flat work supporting platen, or again the feed mechanism and the work supporting means may have a pivotal movement, about a horizontal axis, or may have both a linear and a pivotal movement.

The resilient loading of the feeding mechanism and work supporting means is preferably variable, e.g. by mechanical adjustment of spring means acting between them and any convenient fixed portion of a general structure of the sewing machine. Preferably means are provided for obtaining a plurality of predetermined settings of upward loading, and the pre-settings may themselves be adjustable, thereby to permit the obtaining of optimum feed pressures.

With such a construction, as so far described, any adequate downward pressure exerted by hand by the operator on the work supporting means, during sewing, will cause further separation of the feeding mechanism and the upper presser element, thereby freeing the material to be manoeuvred by hand, e.g. re-orientated about the needle axis, without the need to stop the machine. Again, when sewing has been terminated, and assuming that the needle is in raised position clear of the material, the material can then be freely pulled away from between the feeding means and the presser element.

The work supporting means may be so arranged, in relation to other fixed structure of the machine, that it can perform a downward movement, away from the raised first position, to a predetermined extent and upon release will return automatically to its raised first position under the action of the resilient loading, whereas if that predetermined extent of downward movement is exceeded and the work supporting means reaches a predetermined second position it will become automatically latched by latching means in the second position.

The latching means is advantageously so arranged that a further small movement of lowering of the work supporting means, beyond said second position, causes release of the latching means to permit the work supporting means and the feeding mechanism to rise to the first raised position under their resilient loading.

In an electrical sewing machine there may be switching means for a drive motor of the machine, said switching means being actuatable, upon the feed mechanism and work supporting means reaching said second position, to cut off electrical current to said drive motor, with however preferably a facility remaining to cause the needle drive to be "inched" by use of the usual power control of the machine, e.g. a foot pedal switch.

The feed mechanism and work supporting means may be releasable latchable by said latching means in a still further lowered third position, switching means being operable, upon the feed mechanism and work supporting means reaching said third position, to interrupt electrical current feed to at least an electrical needle drive mechanism of the machine, e.g. power to at least the needle drive is cut off and cannot be restored by an operation of the usual foot pedal switch, the work supporting means being thus releasably latchable in that third position for complete temporary immobilisation of the machine.

The sewing machine may comprise control means for needle operation, the arrangement being such that movement of the feed mechanism and work supporting means into said second position causes stopping of the needle in needle-down condition, so that the sewn material may be moved about the axis of the needle, and movement of the feed mechanism and work supporting means into said third position causes halting of the needle in needle-up position, so that material may be removed.

Thread tensioning means of the machine may be so arranged that movement of the feed mechanism and work supporting means into said third position causing release of thread tension, e.g. by use of switch means to alter the circuit conditions of an electro-mechanical system controlling thread tension.

According to a second aspect of the invention, a sewing machine comprises a thread take-up element, and means for driving said take-up element including a rotary axially-acting cam and a cam follower coacting with said rotary cam and coupled to said take-up element. The cam follower and take-up element may be integral.

The rotary cam may have one or more camming ribs on its outer periphery, and the cam follower may have one or more recessed elements adapted to receive and run on said camming ribs.

In a preferred form, the cam follower coacts symmetrically with two portions of said rotary cam at 180° apart, for which purpose the cam follower may include a yoke having arms which embrace the rotary cam with clearance, each arm serving as or carrying a follower for a respective opposed portion of the cam.

The yoke may be pivoted such that an angular reciprocation is performed, and in a convenient structure the take-up element is formed as a second arm of a two-arm lever, the first arm of the lever being constituted by said yoke.

In accordance with a further feature of the invention, the same rotary cam is utilised to derive a complex movement of the take-up arm in relation to the reciprocation of the needle. For this purpose, there is provided a separate and distinct camming formation on said cam, and a second cam follower coupled to means for reciprocation of a needle.

The rotary cam may be a tubular member having the take-up arm camming formation on its external periphery, and having the needle reciprocation camming formation on its internal periphery. The cam follower for needle reciprocation thus moves axially within the rotary cam.

The rotary cam element may be rotated by coupling it to any convenient rotating portion of the mechanism of the sewing machine, for example by meshed pinions on the rotary camming element and a main upper horizontal drive shaft of the machine. In another form, the rotary cam is itself driven from the mechanism which ensures reciprocation of the needle. For example, the cam follower coacting with the second cam formation may be coupled to, carried by, or formed on an axially reciprocated needle carrier, the carrier itself being powered for its reciprocal movement, e.g. by being coupled to or forming part of a linear motor such as a stepping motor. The respective first and second camming formations may thus be each designed for producing exactly the correct desired rate of movement, rate of change of movement, and amplitude of movement, the respective phasing, required for the take-up element movement and the needle reciprocation movement.

The motion of the take-up element may thus be controlled exactly to suit the stitching cycle and is not dictated by the known limitations of the traditional take-up mechanism. Also the cam formations may be so designed as to provide a polynomial shape, thereby providing the most practical acceleration rates for the take-up element.

According to a third aspect of the invention, a foot-operable electrical control comprises a support structure, a foot-actuatable member carried by the support structure and movable within limits with respect thereto over a range of movement, means serving to locate the foot-actuatable member releasably at and/or to urge the foot-actuatable member towards an unconstrained rest position intermediate the ends of said range of movement, and respective electrical control means operable by movement of the foot-actuatable member to one side and the other of its rest position.

In a preferred form, there are provided further switching means operable by movements of the foot-actuatable member intermediate its rest position and a displaced position at which the control means come into operation, at one or both sides of the rest position.

The main control means may advantageously be variable-property electrical devices, e.g. variable resistances of the linear slide or rotary slider type. Alternatively, the switch means may have a plurality of contact studs coacting with a wiper.

In use, the control of the inventon retains its foot-actuated member in its rest position, and all switch means or control means are at "off" or zero condition. The operator's foot is rested on the foot-actuated member, and the latter can be rocked away from rest in a first direction by pressure with the toe or ball of the foot, and in a second direction with the heel of the foot. As the movement is increased, change of electrical property can be obtained, e.g. to give increasing speed to the motor in the reverse direction, according to whether the toe or heel movement is used. Where the first control means are provided, these may be used to provide an additional switching function, such as "inching" of a controlled motor, in the forward direction or in the reverse direction as the case may be.

Provision may be made for eliminating, mechanically or electrically, the operation of the further switching means when the foot-actuated member is returning towards its rest position, in one or both directions of return.

On electrically-powered sewing machines, it is known to provide a foot switch control, so that the hands are left free to concentrate on the complexities of machine sewing. The foot switch control accelerates, decelerates and halts the needle action of the machine, by regulating the electrical power to the prime mover that drives the sewing machine. On the conventional foot control, pressure is applied to a footplate by the ball of one foot to move it progressively downwards to speed up the rate of stitch of the sewing machine, and conversely lifting of the ball of the foot reduces speed and eventually stops the motor. This is the only function of the known foot control.

The foot-actuated control of the present invention enables a plurality of functions to be carried out by the single foot.

At times, it is necessary to reverse the direction of the stitching action of a sewing machine. For example, this is done when, on completing a stitch run, the operator wishes to reverse over the stitches to lock the previous run to prevent the materials from coming apart.

To reverse the machine it is at present normal to use a control knob or lever on the machine body, which necessitates removal of one hand from the material being sewn, with subsequent temporary loss of control and unnecessary inconvenience.

With the present invention, the machine operator may continue to exert full control with both hands over the material being sewn, the action of reversing the stitch of the sewing machine being carried out by the foot already on the foot-actuated control.

In order that the nature of the invention may be readily ascertained, embodiments of sewing machine and foot control incorporating the invention are illustrated in the accompanying drawings, wherein:

FIG. 1 is a perspective elevation of part of a sewing machine, viewed from the position of an operator;

FIG. 1*a* is a schematic view of a section through part of the sewing machine;

FIG. 3 is a schematic perspective view, to an enlarged scale, of a camming barrel and associated needle drive member and take-up arm and yoke;

FIG. 4 is a schematic side view, with parts shown in section, of a foot-operable control.

Figure 1:
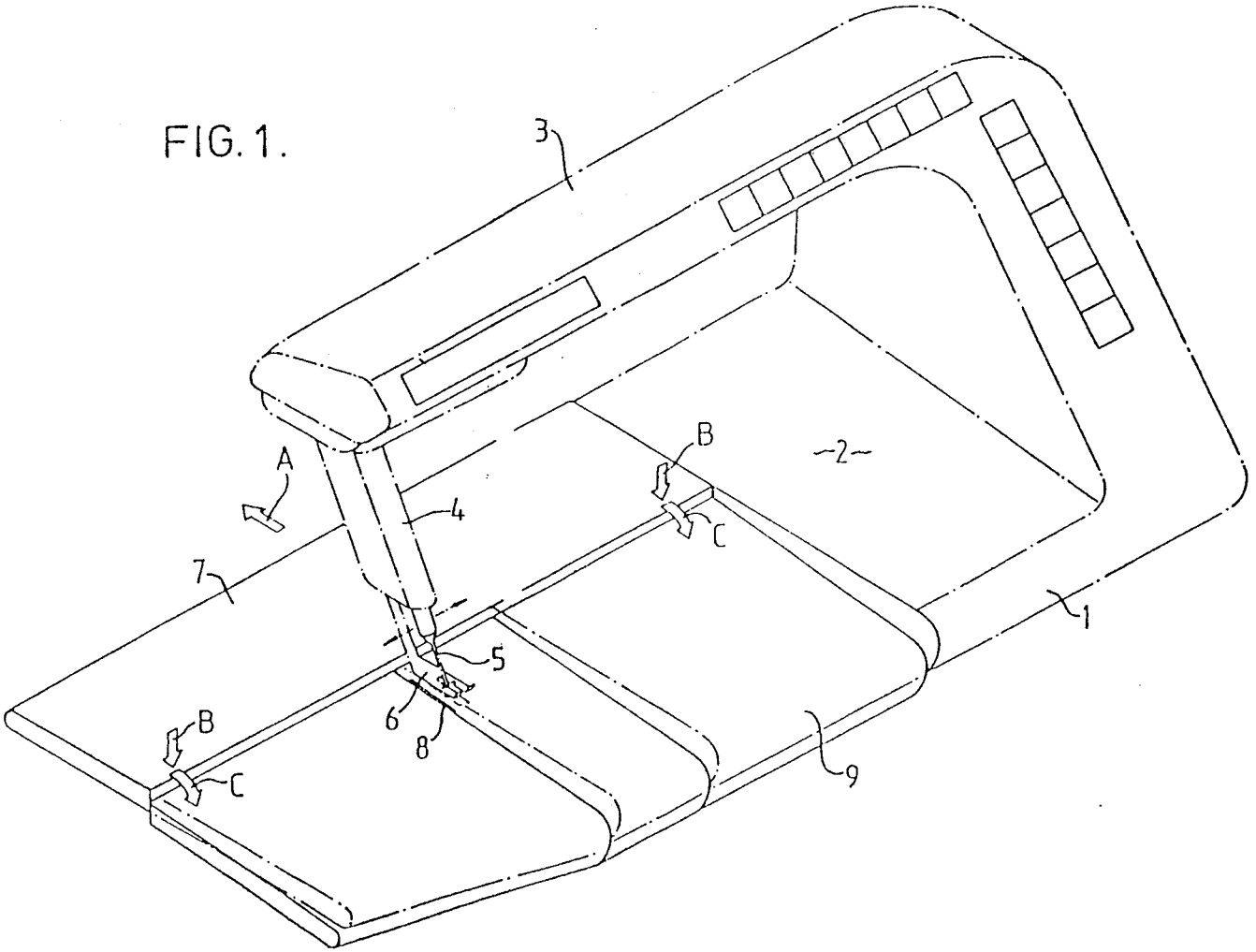
Figure 1A:
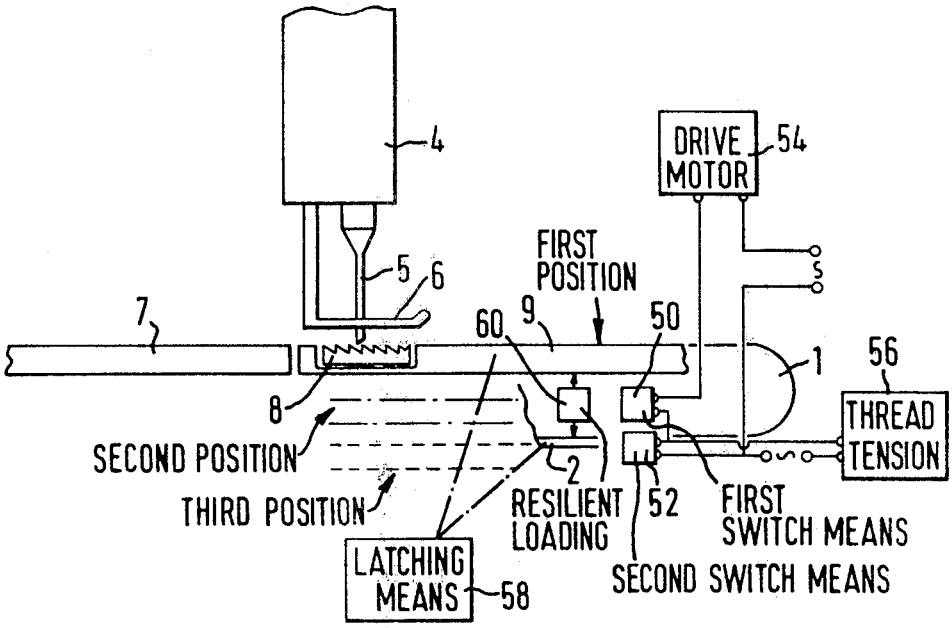

Referring to FIG. 1 and FIG. 1*a* of the drawing, the sewing machine has a general body structure 1 including a base 2 and an overhead arm 3. The arm 3 carries a needle pillar 4 having a reciprocate needle 5 arranged to pass through an upper presser foot 6.

On the base 2 there is provided a fixed work supporting surface 7 which is downstream of the needle 5 as the work moves in the direction of the arrow "A."

Below the presser foot 6 there is positioned the usual serrated feed dog 8 which reciprocates along the direction of the arrow "A," the material being gripped between the feed dog 8 and the underside of the presser foot 6.

The feed dog 8 and its associated mechanism is carried by a platen 9 which has a rest position in which its upper surface is substantially level with the upper surface of the surface 7 and the remainder of the base 2. The platen 9 is movable downwardly, out of that first position, to at least a second and lowered position, either by movement normal to its own plane, as indicated by the arrows "B," or with an angular movement about a horizontal axis, as indicated by arrows "C," or possibly with both of such movement combined. Movement of the platen 9 into its second position, or third position if provided, relative to the base 2, causes actuation of first and second switches 50 and 52 which control the operation of at least the electrical drive meter 54 for the needle 5, and also other functions such as thread tension control 56. Simple releasable latching means 58 are coupled between the platen 9 and the base 2 to hold the platen 9 in its second, or second and third, positions until manually released, e.g. by still further downward movement through a small amplitude a resiliant loading structure 60 bias platen 9 toward its original position.

With the construction described, the release of pressure on the material, the halting of the needle in needle-up position, the release of thread tension etc. can all be obtained by simple variation of hand pressure on the platen 9, so that the operator can continue to hold the material with both hands without need to release it.

Figure 2:
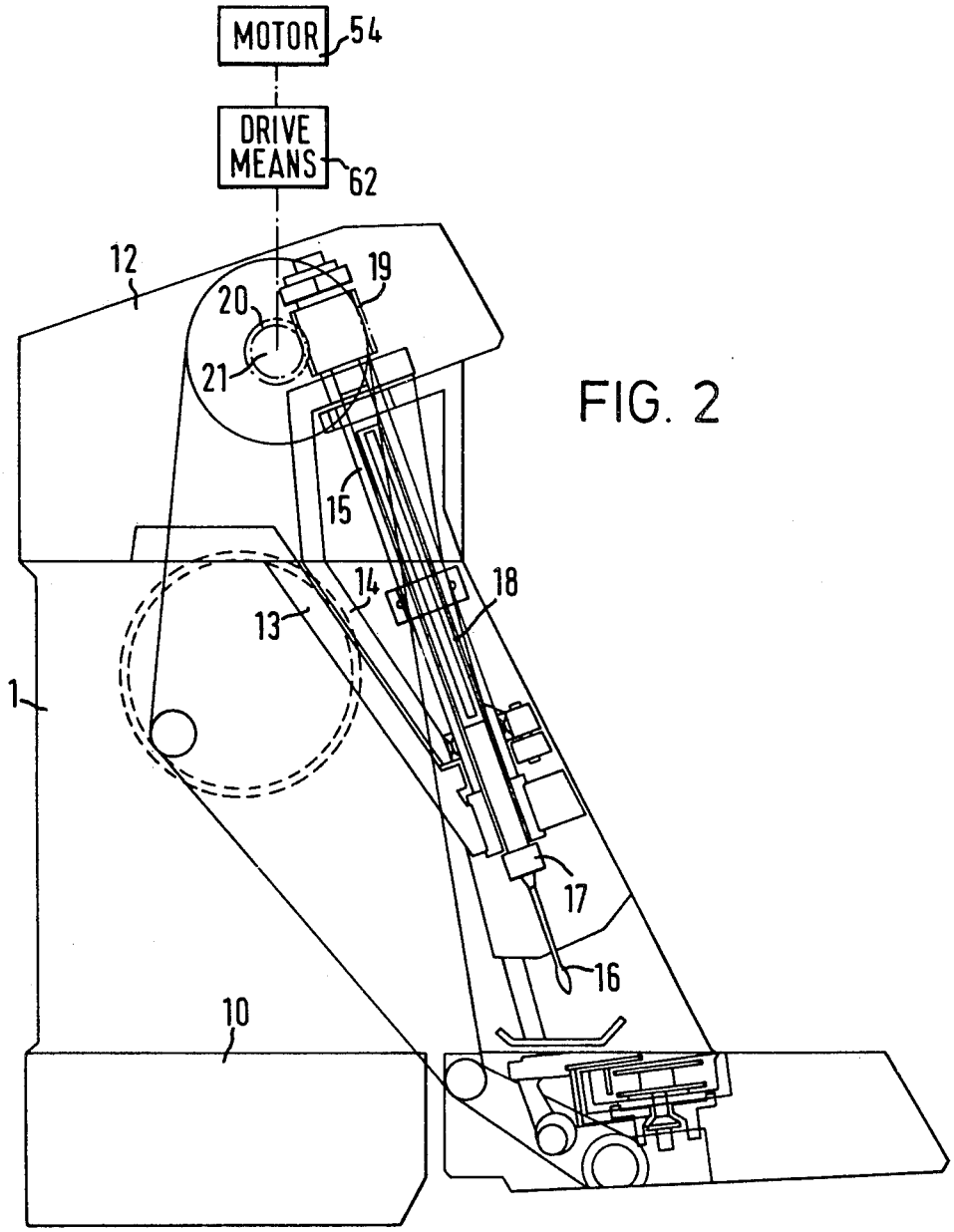
FIG. 2 is an outline schematic end elevation of the sewing machine head to illustrate a needle drive mechanism and the position of a cam barrel incorporated in a take-up arm drive mechanism.

Referring now to FIG. 2, the machine comprises a base 10 on which an upstanding structure 11 carries a head 12. The head 12 has a structure 13, 14 carrying a rotary cam barrel 15. A reciprocable needle 16 and its associated chuck 17 are carried on a tubular element 18 which is axially reciprocable within the barrel 15. Axially-acting camming means, described in greater detail with reference to FIG. 3, serve to couple the barrel 15 and the tubular element 18 reciprocating axially within it.

The barrel 15 may be rotated in, for example, either of two different manners, both of which are illustrated in the drawing. A first manner of rotation of the barrel 15 is obtained by providing on the barrel, at the upper end, a pinion 19 meshing with another pinion 20 mounted for rotation on a main horizontal drive shaft 21 of the sewing machine. Shaft 21 is driven by motor 54 through a suitable drive 62. A second manner excludes the pinions 19, 20 and the shaft 21, and instead has the tubular element 18 of the needle coupled to or forming part of a reversing linear motor. In this case, the reciprocation of the tubular element 18, as a prime mover, itself causes rotation of the barrel through the action of the camming formation acting between the tubular element and the barrel.

Referring now to FIG. 3, the barrel 15 is shown as having on its outer peripheral surface an axially acting camming rib 23 which can coact, at opposed sides of the barrel, respectively with each of two cam follower elements 24 pivotably mounted on respective arms 25 of a yoke 26 pivoted at 27 on any convenient fixed portion of the structure. The yoke is continued to form a two-arm lever of which the second arm 28 has an opening 29 to enable the arm 29 to act as a thread take-up arm.

The central item of the three coaxial items shown in FIG. 3 is a view of the internal peripheral surface 30 of the same barrel 15, and is not a separate element. The internal periphery has a camming groove 31 which is adapted to coact with a cam follower in the form of a radial stud 32 secured on the outside of the tubular element 18 which performs the needle reciprocation. By suitable relative shaping of the cam formations 23 and 31, any desired characteristics of relative and individual movements of the take-up arm 28 and the needle tube 18 can be obtained.

A major advantage of this improvement is that the barrel 15 may rotate at a constant speed and thus primary velocity and inertial problems are reduced as compared with those experienced with conventional cranked movements. Also, by judicious design and use of material the reciprocating yoke mass may be minimized. Another advantage of this improvement is that a reduced design profile can be adopted about the sewing head. Also, running noise produced by the usual crank and compound linkage is largely eliminated.

Referring now to FIG. 4, the foot-operable control comprises a base 33 carrying bracket means 34 serving as a support structure for a foot pedal 35 mounted on the brackets by pivot means for rotation about a tilt axis 36. A compressible and extensible helical spring 37 is secured to the base 33 by a screw 38 and plate 39, and is also secured to the foot pedal 35 by means of a screw 40 and plate 41. The spring is dimensioned such that, in unconstrained condition, i.e. when there is no foot present on the pedal 35, or when the foot is rested only lightly and in equilibrium on the pedal 35, the pedal has a symmetrical rest position as shown. To give the operator a feel of location of the foot pedal 35 in the symmetrical rest position, there may be provided means such as a spring blade 42 having a riser portion 43 to locate into a notch 44 on the bracket means 34.

Secured to the foot pedal 35, for angular movement about the axis 36, there is provided a wiper arm 45 carrying a wiper contact 46 which coacts with separate electrical resistance windings 47*a*, 47*b*. When the foot pedal is in the symmetrical position shown, the wiper 46 is out of contact with both of the windings. As soon as the pedal is depressed with the toe or ball of the foot, or with the heel, the wiper 46 commences to wipe along the respective winding, and as the tilting action of the pedal 35 is increased, the wiper progressively wipes along the respective winding. By way of example, the coaction of the wiper 46 with the winding 47*b* could control forward speed of the sewing machine motor, and coaction of the wiper 46 with the winding 47*a* could control reverse speed of the motor.

Pillars 48 and abutments 49 are provided on the base 33 and pedal 35 respectively to limit the extent of tilting movement. These means 48, 49 may act simply as physical stops to the tilting motion, or may further incorporate switch means which, for example, cut out the resistance windings 47*a* or 47*b* completely to give "full speed" when the tilting action is at a maximum.

Provision may be made for a commencing portion of the tilting action, e.g. the first few degrees away from the rest position shown, to provide a short slow speed operation, of a "one-off" nature, e.g. for "inching" of the motor to obtain a single upstrike or downstroke of the needle. Preferably, the inching connection would be made only when the tilting action is commencing from the symmetrical position shown and is moving towards the maximum forward or reverse position, whereas when the foot pedal 35 is coming back from more extreme positions towards the rest condition the "inching" connection is not then made, e.g. by including a non-reversible lost motion linkage.

The foot pedal 35 receives the whole of the foot and the pivot axis 36 is substantially below the ankle, thus permitting the pedal to be rocked easily forwards and backwards with appropriate pressure of the toe or ball of the foot, or the heel of the foot.

As used with a sewing machine, for example, pressure applied progressively with the toe or ball of the foot will cause the foot pedal to be progressively tilted with appropriate increase of speed of the sewing machine motor in the forward direction up to a maximum. Again, starting from rest condition as shown, pressure applied progressively with the heel of the foot will cause the foot pedal to be progressively tilted in the other direction from rest, with appropriate increase of speed of the sewing machine motor in the reverse direction, up to a maximum. "Inching," if incorporated, can be obtained by moving the pedal only slightly with the toe or ball of the foot, or with the heel of the foot, in the appropriate direction, and continued movement in the selected direction then provides normal progressive control in that same direction.

I claim:

1. A sewing machine comprising:

(i) a body structure including an overhead arm, (ii) a work presser foot supported by said overhead arm, (iii) a work support platen carried by said body structure and having a reciprocable feed dog disposed below and aligned with said presser foot, said work support platen being movable with respect to said body structure into a first position in which said feed dog is adjacent to the underside of said presser foot and into a second position in which said dog is spaced further below said presser foot, and (iv) resilient loading means coupled to and acting between said body structure and said work support platen and urging said platen and feed dog towards said first position.

2. A sewing machine, as claimed in claim 1, including latching means on said body structure arranged to latch said platen releasably in said second position.

3. A sewing machine, as claimed in claim 1, further comprising a drive motor having a current feed circuit, and first switch means on said body structure operable by said platen and included in said current feed circuit, said first switch means being arranged to open said current feed circuit when said platen moves downwardly into said second position.

4. A sewing machine, as claimed in claim 3, wherein said platen and said feed dog are movable into a third position below said second position, wherein said latching means are arranged to latch said platen releasably in said third position, and wherein there are provided second switching means on said body structure disposed in said current feed circuit and operable by said platen, said second switching means being arranged to become open circuit when said platen moves downwardly into said third position.

5. A sewing machine, as claimed in claim 4, further comprising a needle-driven mechanism on said body structure for a reciprocable needle disposed to pass through said presser foot, and drive means connecting said drive motor to said needle-drive mechanism, operation of said first switch means to open said current feed circuit causing said needle-driven mechanism to stop in needle-down position, and operation of said second switch means to open said current feed circuit causing said needle-drive mechanism to stop in needle-up position.

6. A sewing machine, as claimed in claim 4, comprising thread tensioning means on said body structure, and coupling means acting between said platen and said thread tensioning means to cause release of thread tension when said platen moves into said third position.

7. A sewing machine comprising:

(i) a body structure including an overhead arm, (ii) a work pressure foot supported by said overhead arm, (iii) a work support platen carried by said body structure and having a reciprocable feed dog disposed below and aligned with said presser foot, said work support platen being movable with respect to said body structure into a first position in which said feed dog is adjacent to the underside of said presser foot and into a second position in which said feed dog is spaced further below said presser foot and into a third position below said second position, (vi) latching means on said body structure arranged to latch said platen releasably in said second position and in said third position, (v) resilient loading means coupled to and acting between said body structure and said work support platen and urging said platen and feed dog towards said first position, (vi) a drive motor having a current feed circuit, (vii) first switch means on said body structure operable by said platen and included in said current feed circuit, said first switch means being arranged to open said current feed circuit when said platen moves downwardly into said second position, (viii) second switch means on said body structure disposed in said current feed circuit and operable by said platen, said second switching means being arranged to become open circuit when said platen moves downwardly into said third position.

* * * * *